US005491910A

United States Patent [19]

Zorzi

[11] Patent Number: 5,491,910

[45] Date of Patent: Feb. 20, 1996

[54] SEALING DEVICE FOR SKI BOOTS

[76] Inventor: Claudio Zorzi, Via dei Fanti 17, 31050 Paderno di Ponzano Veneto (Prov. of Treviso), Italy

[21] Appl. No.: 320,592

[22] Filed: Oct. 11, 1994

Related U.S. Application Data

[63] Continuation of Ser. No. 69,800, Jun. 1, 1993, abandoned.

[30] Foreign Application Priority Data

Jun. 16, 1992 [IT] Italy ..... TV92U0036

[51] Int. Cl.[6] ..... A43B 11/00; A43B 5/04

[52] U.S. Cl. ..... 36/50.5; 36/117; 24/68 SK

[58] Field of Search ..... 36/117–121, 54, 36/50.5, 50.1, 4; 24/68 SK, 69 SK, 70 SK, 71 SK

[56] References Cited

U.S. PATENT DOCUMENTS

| | | | |
|---|---|---|---|
| 347,653 | 8/1886 | Sloan | 36/50.1 X |
| 751,432 | 2/1904 | Hopper | 36/54 |
| 780,036 | 1/1905 | Holland | 36/54 |
| 1,190,305 | 7/1916 | Leichter | 36/54 X |
| 1,253,496 | 1/1918 | Kaiser | 36/54 |
| 2,494,964 | 1/1950 | Rome | 36/50.5 X |
| 3,597,862 | 10/1971 | Vogel . | |
| 3,657,827 | 4/1972 | Rieker | 36/50.5 X |
| 3,783,534 | 1/1974 | Phillips et al. | 36/54 X |
| 4,193,215 | 3/1980 | Hensler | 36/50.5 X |
| 4,461,103 | 7/1984 | Annovi | 36/117 X |
| 4,470,206 | 9/1984 | Annovi | 36/50.5 X |
| 4,669,202 | 6/1987 | Ottieri | 36/50.5 X |
| 5,068,984 | 12/1991 | Kaufman et al. | 36/120 X |
| 5,228,219 | 7/1993 | Tonel | 36/50.5 X |

FOREIGN PATENT DOCUMENTS

| | | | |
|---|---|---|---|
| 0517219 | 12/1992 | European Pat. Off. . | |
| 0605287 | 7/1933 | Germany | 36/54 |
| 1915442 | 10/1970 | Germany . | |
| 8336239 | 2/1984 | Germany . | |

*Primary Examiner*—Paul T. Sewell
*Assistant Examiner*—Ted Kavanaugh

[57] ABSTRACT

Sealing device, particularly usable for ski boots including a shell provided with a first inner flap and with a second outer flap which can mutually overlap. The sealing device is constituted by a single body including a band which can be arranged below the second flap and from which a wing protrudes upward. The wing is arranged adjacent to the lower surface of the second flap and interacts with the upper surface of the first flap. Since the band and the wing are both resilient, perfect tightness to infiltrations between the flaps is achieved when the first and second flaps are made to overlap.

2 Claims, 2 Drawing Sheets

SEALING DEVICE FOR SKI BOOTS

This application is a continuation application of application Ser. No. 08/069,800 filed on Jun. 1, 1993, now abandoned.

BACKGROUND OF THE INVENTION

The present invention relates to a sealing device particularly usable in ski boots comprising a shell provided with overlapping flaps.

The need to limit water infiltration inside the ski boot shell during sports practice is strongly felt. It has in fact been observed that the overlap of the flaps is never such as to eliminate water infiltrations inside the boot.

The flaps are in fact made of relatively rigid material and are subject, during use, to mutual sliding movements which form small gaps especially along the corners of the flaps.

In order to obviate these drawbacks it is known to apply, especially at the transverse edges of the flaps, a pad made of rubber or plastics, the purpose of which is to create a mechanical obstacle to the passage of water from the tip to the flaps during sports practice.

Sealing devices are also known which are constituted by two separate inserts separately applied on different edges of the flaps of the shell; one of the two inserts can be arranged at a longitudinal edge of a flap.

The second insert is in turn constituted by two parts: one can be inserted at the transverse edges of the flaps of the shell, and the other part is associable transversely to the first part toward the tip of the boot.

Even this known solution, described in the Italian patent no. 1,039,942 filed on Jul. 18, 1975, has drawbacks: first of all three components are involved which must be partially assembled together and to the shell, and furthermore the interaction of all of these components with each other and with the flaps does not ensure optimum watertightness between them in any case.

U.S. Pat. No. 3,597,862 discloses a ski boot having a waterproof bat tongue 57 which is however interacting only with the edges of the flaps.

SUMMARY OF THE INVENTION

The aim of the present invention is therefore to eliminate the drawbacks described above in known types by providing a sealing device which allows optimum tightness to water infiltrations on ski boots which comprise a shell provided with overlapping flaps.

Within the scope of the above aim, an important object is to provide a sealing device which is structurally simple and easy to apply to the boot.

Another important object is to provide a sealing device which is reliable and safe in use and does not substantially increase the thicknesses of the boot at the overlapping flaps.

This aim, these objects and others which will become apparent hereinafter are achieved by a sealing device for ski boots including a shell provided with a first inner flap and with a second outer flap which can mutually overlap, characterized in that it comprises a single body constituted by a band, said band being arranged either below or above said first flap and being arranged below said second flap and protruding from said flaps toward the tip of said boot; a wing protruding upward from said band being arranged adjacent to a lower surface of said second flap and interacting with an upper surface of either said first flap or said band, said band and said wing being resilient.

BRIEF DESCRIPTION OF THE DRAWINGS

Further characteristics and advantages of the invention will become apparent from the detailed description of a particular but not exclusive embodiment, illustrated only by way of non-limitative example in the accompanying drawings, wherein.

DESCRIPTION OF THE PREFERRED EMBODIMENTS

Figure 1:
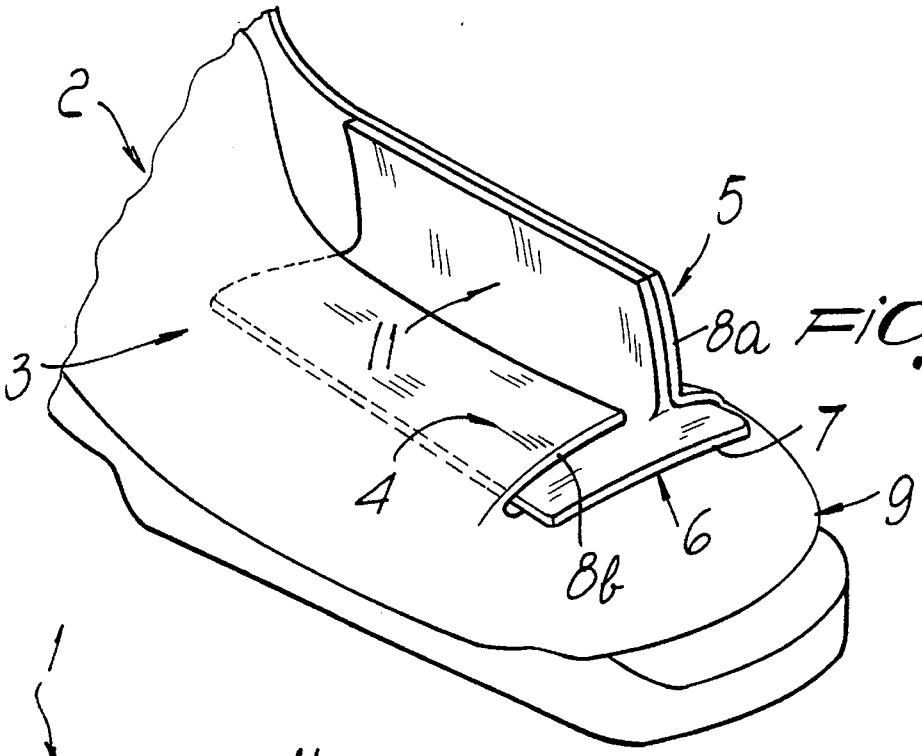
FIG. 1 is a partial perspective view of a ski boot showing the sealing device at the shell with overlapping flaps, in the condition in which said flaps are open.
Figure 2:
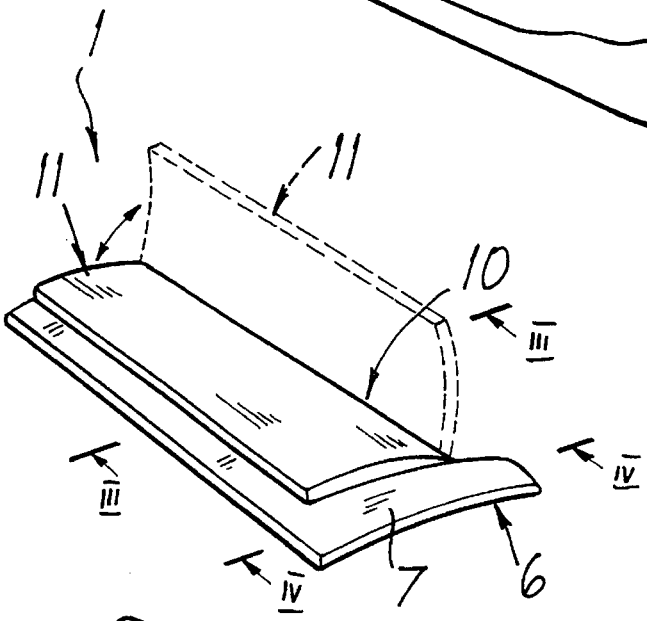
FIG. 2 is a perspective detail view of the sealing device.
Figure 3:
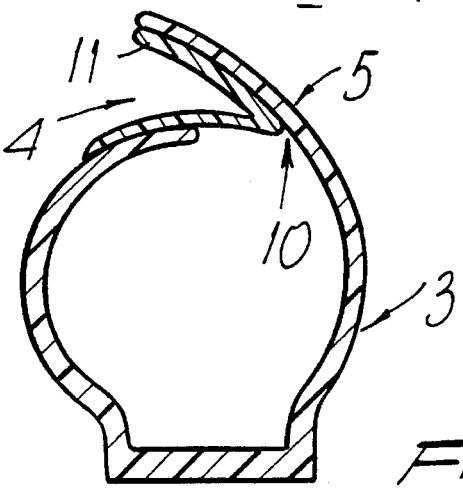
FIG. 3 is a sectional view, taken along the plane III—III of FIG. 2, with the sealing device applied at the shell.
Figure 4:
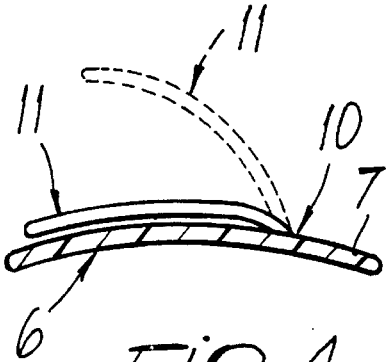
FIG. 4 is a sectional view, taken along the plane IV—IV of FIG. 2.

With reference to the above figures, the numeral 1 designates the sealing device, which is particularly usable in ski boots 2 which comprise a shell 3 provided with a first inner flap 4 and with a second outer flap 5 which can mutually overlap.

The sealing device 1 is constituted by a single body comprising a band 6, made of resilient material, which can be arranged below both the first flap 4 and the second flap 5. The band is substantially rectangular and has such a width as to fit entirely below the flap 4 and partially below the second flap 5.

The band 6 is provided with an end 7 which protrudes beyond the transverse perimetric edges **8*a* and 8*b* of the first and second flaps toward the tip 9 of the shell 3**.

The width of the end 7 is equal to the distance between the points where the first and second flaps couple to the shell.

The end 7 is therefore wider than the band 6, so that it is partially arranged below the transverse perimetric edges **8*a* and 8*b*** of the first and second flaps.

A wing 11 extends upward from the band 6 at the longitudinal edge 10 partially located below the second flap 5; said wing 11 is also made of resilient material and is associable, for example by glueing, with the lower lateral surface of the overlying second flap 5.

Said wing 11 thus interacts at the outer lateral surface of the first flap 4 once the first and second flaps have been made to mutually overlap.

The use of the invention is in fact as follows: once the band 6 has been associated below the first and second flaps, so that the end 7 protrudes beyond the transverse perimetric edges **8*a* and 8*b* of said first and second flaps, and once the wing 11 has been arranged at the inner lateral surface of the second flap 5**, fastening of the flaps produces a seal along the transverse and longitudinal perimetric edges of said flaps.

Water penetration is in fact not possible, because the sealing device affects all the regions in which the flaps overlap each other and the shell.

It has thus been observed that the invention has achieved the intended aim and objects, a sealing device having been obtained which is structurally very simple, is easy to apply to the shell and allows to achieve optimum tightness against water infiltration.

Even any sliding movements of the flaps do not alter this condition, by virtue of the shape of the band 6, of the end 7 and of the wing 11.

Figure 5:
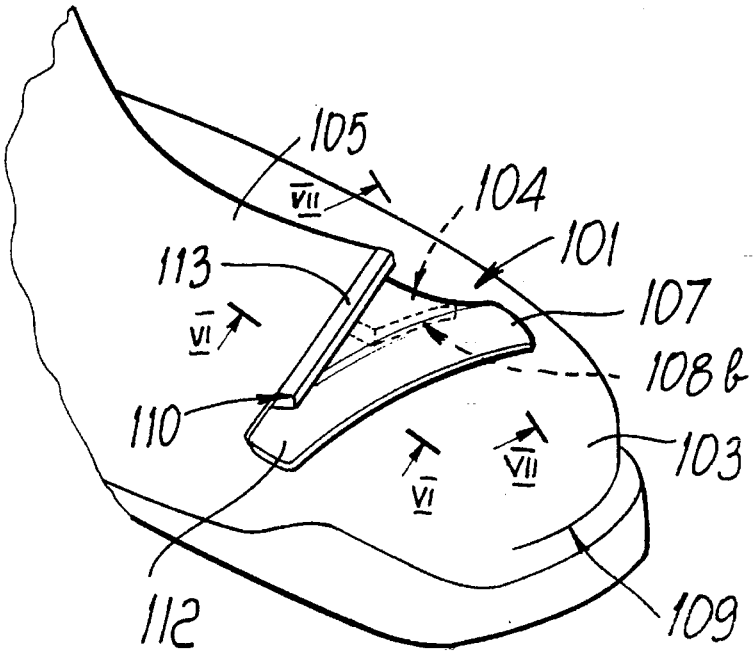
FIG. 5 is a lateral perspective view of a ski boot having a different arrangement of the band.
Figure 6:
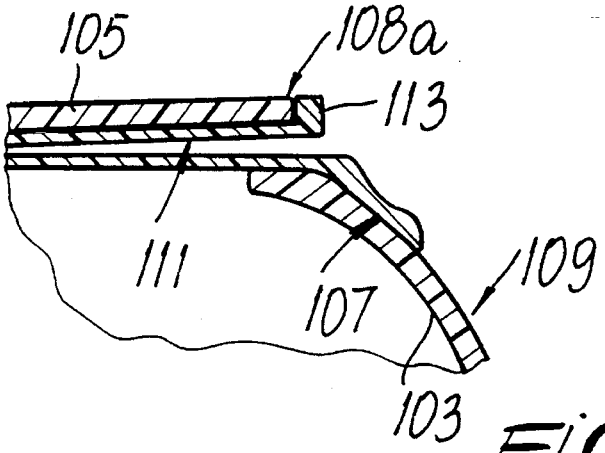
FIG. 6 is a sectional view, taken along the plane VI—VI of FIG. 5.
Figure 7:
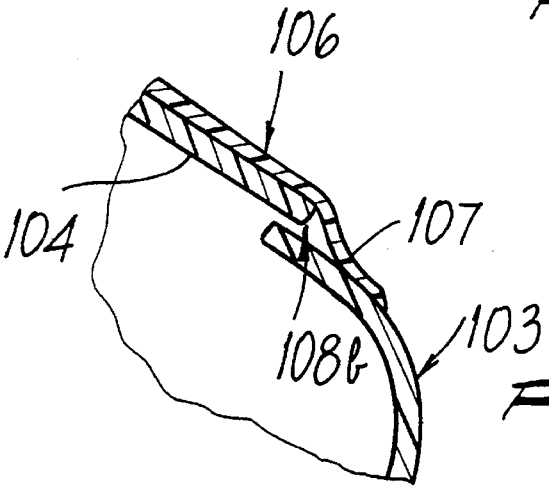
FIG. 7 is a sectional view, taken along the plane VII—VII of FIG. 5.

FIGS. 5 to 7 illustrate a further embodiment of the sealing device 101, which is constituted by a single body comprising a band 106, made of resilient material, which can be arranged above the first flap 104 and below the second flap 105.

Said band 106 is essentially rectangular, with such as width and to fully surmount the first flap 104 and arrange itself partially below the second flap 105.

The band 106 has an end 107 which protrudes beyond the transverse perimetric edges 108*a* and 108*b* of the first and second flaps toward the tip 109 of the shell 103.

The end 107 is wider than the distance between the points where the first and second flaps couple to the shell: it thus fully surmounts the transverse perimetric edge 108*b* of the first flap 104, from which it blends with the underlying shell 110, and protrudes beyond the point 103 where the second flap 105 couples to the shell, forming a lip 112 which is blended with the shell 103.

The wing 111 is instead associated below the second flap 105 and has, at the transverse perimetric edge 108*a* of said flap, a step-like raised portion 113 which abuts against said flap and is thus suitable to increase watertightness.

Naturally, the length of the band, of the wing, of the lip and the height of the step-like raised portion may be the most appropriate according to the specific requirements.

The materials and the dimensions which constitute the individual components of the sealing device may naturally also be the most appropriate according to the specific requirements.

I claim:

1. In combination, a sealing device and a boot, the boot comprising a shell with an inside and with an opening, the boot further comprising a first flap and a second flap which are arranged at said opening, said first flap and said second flap being mutually relatively movable in the boot between a closed position in which said first flap and second flap are mutually overlapping for blocking a user's foot in the inside of the boot and an open position in which a user's foot is able to move in and out of the inside of the boot, said opening of said shell of the boot being positioned between said first flap and said second flap, said second flap being arranged above and overlapping said first flap with respect to the inside of the boot when said flaps are in the closed position thereof, and thereby said first flap being an inner flap and said second flap being an outer flap, said inner flap having an inner side directed towards the inside of the boot and an outer side directed away from the inside of the boot, and said outer flap having an inner side directed towards the inside of the boot and an outer side directed away from the inside of the boot, said sealing device comprising a band element portion and a wing element portion extending from said band element portion, said wing element portion and said band element portion being resiliently bendable with respect to each other, said sealing device being arranged at said opening of said shell, said band element portion covering at least a portion of said inner flap of said shell and said wing element portion covering at least a portion of said outer flap of said shell, thereby for sealing fluid out of the inside of said shell of the boot, and said wing element portion of said sealing device being movable together with said outer flap between said closed position and said open position, and said band element portion being movable together with said inner flap between said closed position and said open position, wherein said inner flap has a transverse perimetric edge and said outer flap has a transverse perimetric edge, and wherein said band element portion has an end which extends in a longitudinal direction beyond said transverse perimetric edges and beyond said opening of said shell of the boot, and wherein said wing element portion has an outer surface which is directed away from the inside of the boot and which is connected to the inside of said outer flap, and wherein said band element portion has an outer surface which is directed away from the inside of the boot and which is connected to the inner surface of said inner flap.

2. In combination, a sealing device and a boot, said boot comprising a shell having an inside and an opening, a first flap and a second flap arranged at said opening, said first flap and said second flap being mutually relatively movable in the boot between a closed position, whereat said first flap and second flap mutually overlap for blocking a user's foot in the inside of the boot and an open position, whereat a user's foot is able to move in and out of the inside of said boot, said opening being positioned between said first flap and said second flap, said second flap being arranged above and overlapping said first flap with respect to the inside of the boot when said flaps are in the closed position thereof, and thereby said first flap being an inner flap and said second flap being an outer flap, said inner flap having an inner side directed towards the inside of the boot and an outer side directed away from the inside of the boot, and said outer flap having an inner side directed towards the inside of the boot and an outer side directed away from the inside of the boot, said sealing device comprising a band element and a wing element extending from said band element, said wing element and said band element being resiliently bendable with respect to each other, said sealing device being arranged at said opening of said shell, said band element covering at least a portion of said inner flap of said shell and said wing element covering at least a portion of said outer flap of said shell, thereby for sealing fluid out of the inside of said shell of the boot, said wing element portion of said sealing device being movable together with said outer flap between said closed position and said open position, and said band element portion being movable together with said inner flap between said closed position and said open position, wherein said wing element has an outer surface directed away from the inside of said boot and is connected to the inside of said outer flap, and wherein said band element portion has an outer surface directed away from the inside of the boot and connected to the inner surface of said inner flap.

* * * * *

UNITED STATES PATENT AND TRADEMARK OFFICE

CERTIFICATE OF CORRECTION

PATENT NO. : 5,491,910
DATED : February 20, 1996
INVENTOR(S) : Claudio Zorzi

It is certified that error appears in the above-indentified patent and that said Letters Patent is hereby corrected as shown below:

Title page, item [73], insert assignee: NORDICA S.p.A., Montebelluna (Prov. of TREVISO), Italy--;

Title page, col. 2, under Foreign Patent Document insert --Attorney, Agent or Firm - Guido Modiano, Albert Josif--.

Signed and Sealed this

Fourth Day of June, 1996

*Attest:*

Bruce Lehman

BRUCE LEHMAN

*Attesting Officer*

*Commissioner of Patents and Trademarks*